US005528991A

United States Patent [19]

Huber

[11] Patent Number: 5,528,991

[45] Date of Patent: Jun. 25, 1996

[54] APPARATUS AND ASSOCIATED METHODS OF LAYING TRACK

[76] Inventor: Friedrich Huber, 1550 Spyglass Plaza, Palm Springs, Calif. 92264

[21] Appl. No.: 497,369

[22] Filed: Jun. 30, 1995

[51] Int. Cl.[6] ..... E01B 27/17; E01B 29/06

[52] U.S. Cl. ..... 104/2; 104/7.2; 104/9

[58] Field of Search ..... 104/2, 5, 6, 7.1, 104/7.2, 9, 17.2

[56] References Cited

U.S. PATENT DOCUMENTS

| | | | |
|---|---|---|---|
| 3,288,082 | 11/1966 | Brosnan | 104/2 |
| 3,699,894 | 10/1972 | Plasser et al. | 104/2 |
| 3,713,396 | 1/1973 | Colius | 104/9 |
| 4,119,154 | 10/1978 | Miller | 104/7.3 X |
| 4,232,610 | 11/1980 | Theurer | 104/3 |
| 4,316,416 | 2/1982 | Theurer et al. | 104/2 |
| 4,542,697 | 9/1985 | Cicin-Sain | 104/2 |
| 4,979,247 | 12/1990 | Buhler | 104/5 |
| 5,191,838 | 3/1993 | Hansen | 104/2 |
| 5,357,867 | 10/1994 | Theurer et al. | 104/2 |

*Primary Examiner*—Robert J. Oberleitner
*Assistant Examiner*—Kevin D. Rutherford
*Attorney, Agent, or Firm*—Konneker & Bush

[57] ABSTRACT

Track laying apparatus and associated methods are provided for installing rails on blocks. In a preferred embodiment, a track laying apparatus has an installation portion for installing the blocks to the rails at predetermined lateral and longitudinal spacings, relative to the lengths of the rails, and a positioning portion for propelling and steering the apparatus and lifting and laterally spacing the rails.

20 Claims, 2 Drawing Sheets

APPARATUS AND ASSOCIATED METHODS OF LAYING TRACK

BACKGROUND OF THE INVENTION

The present invention relates generally to methods of laying railroad track, apparatus therefor, and, in a preferred embodiment thereof, more particularly provides apparatus for continuous track laying utilizing dual blocks.

Railroad track is typically laid by placing individual rails atop wooden ties which are sequentially spaced orthogonal to the rails. The wooden ties are conventionally embedded atop ballast material intended to stabilize the earth over which the rails traverse. After the rails are placed on the wooden ties they are spaced apart according to the proper "gauge" (lateral spacing between the rails of a track), longitudinally joined to correspondingly spaced rails, and fastened to the wooden ties with spikes.

It is well known in the art to automate the railroad track laying procedure. U.S. Pat. No. 4,232,610 to Theurer discloses an apparatus which lays completed portions of track end to end while the apparatus propels itself on the previously laid track. The completed portions of track include the spaced apart rails fastened to wooden ties.

U.S. Pat. No. 3,713,396 to Colius discloses an apparatus for sequentially spacing and fastening wooden ties to continuous rails. A turntable mechanism is used to drop a tie longitudinally between the rails and then turn the tie so that it is orthogonal to the rails. The tie is then fastened to the spaced apart rails with spikes.

Additionally, it is well known in the art to renew old railroad track rails and/or wooden ties. U.S. Pat. No. 5,357,867 to Theurer et al. discloses an apparatus which renews old railroad track or, if properly configured, lays new track. In order for the new wooden ties to be placed on the ballast, the rails must be widely spaced apart so that the ties will fit transversely between the rails. The apparatus then places the wooden ties on the ballast, gauges the rails, and fastens the rails to the ties. A similar apparatus which includes ballast conditioning features is disclosed in U.S. Pat. No. 4,316,416 to Theurer et al.

For subway applications, a modern technique of laying railroad track utilizes a "dual block" system wherein there are no ties fastened to the spaced apart rails. Instead, the rails are supported on masonry blocks which have elastomeric pads attached to their bottom surfaces for noise and shock suppression. The rails are typically fastened to the blocks, "gauged", and supported up off of grade level so that concrete may be poured around and underneath the blocks, effectively encapsulating the bottoms of the blocks.

Subways are becoming more common as cities grow more congested, and the use of "dual blocks" for supporting rails is increasing as well. The benefits which accrue from the use of blocks instead of ties include reduced noise and shock, and minimal maintenance. The disadvantages of using blocks include increased installation costs.

The above-described process of laying track on blocks is tedious and time-consuming and a need exists for its automation. Unfortunately, none of the existing track laying or renewal apparatus or methods, which were designed for use with wooden ties in an open environment, are suited for laying rails on blocks, nor are they suited for use in the confines of a subway tunnel.

Lateral space is limited in a subway tunnel, so those apparatus which are adapted for spreading of the rails prior to placement of wooden ties therebetween, or picking up of previously spread rails, prior to placement of the rails on wooden ties are unusable therein. Vertical space is also limited in a subway tunnel, so those apparatus which are adapted for lifting track sections or rails over a large structure for placement in front of or behind the large structure are likewise unusable.

Additionally, virtually all of the apparatus adapted for laying track with wooden ties require the apparatus to travel supported, at least in part, on the newly installed track. This cannot be done in dual block installations, which cannot support travel thereupon until the blocks are encapsulated in concrete.

Furthermore, existing apparatus and methods do not take advantage of the unique features available in a modern subway tunnel. For example, electricity and/or compressed air are normally available as sources of power to propel a track laying apparatus. The tunnel, having already been constructed, defines the path the track will follow, and structures therein, such as wiring troughs, may be utilized to provide guidance for a track laying apparatus. In addition, other structures within a tunnel may be utilized for placement of track laying supplies which may be used by the track laying apparatus as it proceeds through the tunnel.

From the foregoing, it can be seen that it would be quite desirable to provide automated track laying apparatus and methods which are suited for the laying of track utilizing dual blocks. Furthermore, such apparatus and methods are needed which may operate in the confines of a subway tunnel. Still further, such apparatus and methods are needed which are adapted to take advantage of the features existing in a modern subway tunnel. It is accordingly an object of the present invention to provide such track laying apparatus and methods.

SUMMARY OF THE INVENTION

In carrying out the principles of the present invention, in accordance with an embodiment thereof, track laying apparatus and methods are provided which facilitate the laying of rails on blocks and attachment thereto, and which are particularly suited for efficient operation in a subway tunnel.

In broad terms, track laying apparatus is provided which includes an articulated framework, a plurality of wheels operatively attached to and supporting the framework, means mounted to the framework for lifting the rails, means mounted to the framework for spacing the rails a predetermined lateral distance apart from each other, means for steering the framework on the roadbed, means for propelling the framework on the roadbed, first means mounted to the framework for transporting the blocks from a first position exterior to the framework to a second position interior to the framework, means at the second position for spacing the blocks a predetermined transverse and longitudinal distance apart from each other, and second means for transporting the blocks from the second position to a third position adjacent the rails.

A method of laying railroad track is also provided, the method comprising the steps of disposing the rails longitudinally on the roadbed, lifting the rails from the roadbed, spacing the rails apart from each other to a predetermined lateral distance, spacing the blocks apart from each other to the predetermined lateral distance and a predetermined longitudinal distance, positioning the blocks adjacent the rails, fastening the blocks to the rails, providing a spacer for maintaining the predetermined lateral distance between the rails, installing the spacer on the rails, and laying the rails and blocks onto the roadbed.

The use of the disclosed track laying apparatus and methods permits efficient installation of railroad track utilizing blocks instead of ties. Especially adapted for use in a subway tunnel, the present invention is operable therein and able to benefit from facilities available in the tunnel.

DETAILED DESCRIPTION

Figure 1:
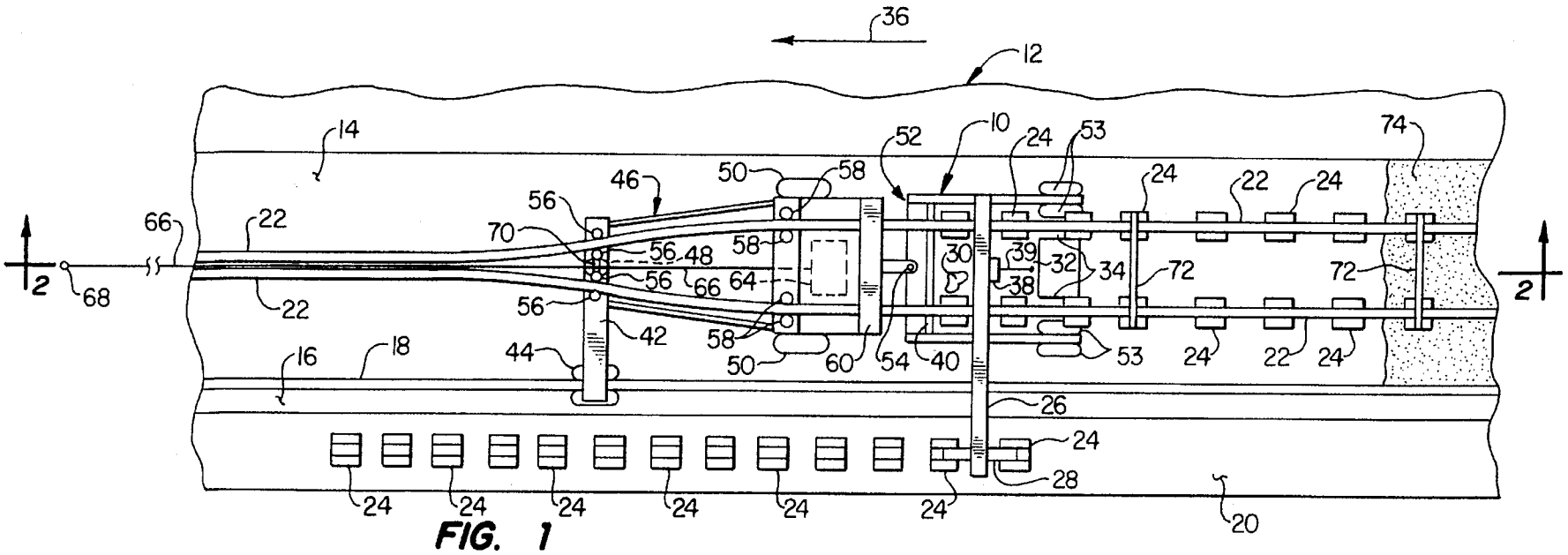
FIG. 1 is a top plan view of apparatus for laying track embodying principles of the present invention, the view illustrating the apparatus laying track in a subway tunnel.
Figure 2:
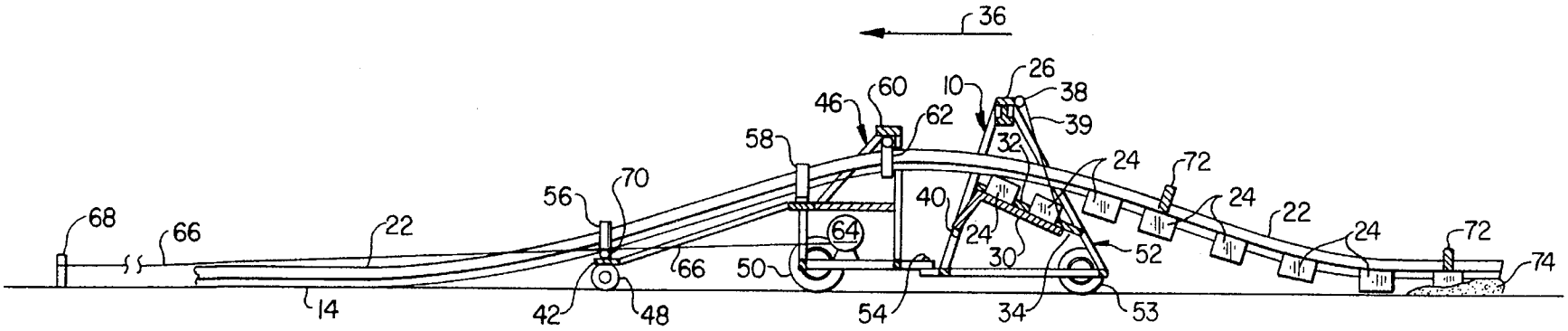
FIG. 2 is a cross-sectional view through the apparatus, taken along line 2—2 of FIG. 1.

Illustrated in FIGS. 1 and 2 is a track laying apparatus 10 which embodies principles of the present invention. The apparatus 10 is illustrated in a subway tunnel 12 having a roadbed 14 approximately in the center thereof and extending longitudinally therethrough. The roadbed 14 is the portion of the tunnel 12 onto which track is to be laid.

At one side of the roadbed 14 is a cableway 16 for enclosure of, for example, electrical cables. An upright wall 18 separates the cableway 16 from the roadbed 14. On the opposite side of the cableway 16 from the roadbed 14 is a walkway 20 which has a concrete surface.

A side-by-side pair of continuous rails 22 are initially placed on, parallel to, and approximately in the center of, the roadbed 14 as shown in the leftmost portion of FIG. 1. It is convenient in subway construction for the rails 22 to be in this initial placement so that, before the rails are mounted to blocks (described hereinbelow), vehicles may travel along the subway tunnel 12 on the roadbed 14 with their wheels straddling the rails.

Blocks 24 are initially distributed along the walkway 20 where they may be conveniently accessed by the apparatus 10. A small crane 26 of conventional construction extends laterally across the midsection of the apparatus 10 and over the walkway 20 sufficiently far so that it can lift and transport the blocks 24 from the walkway 20 to the apparatus 10. The crane 26 has a lifting fixture 28 of conventional construction for lifting a pair of blocks 24 at one time.

The blocks 24 are loaded by the crane 26 onto table 30 where they are placed in a template 32 having the proper spacing both laterally and longitudinally for the blocks. The template 32 accepts four blocks 24 and is configured for straight sections of track as representatively illustrated in FIG. 1. Another template for use with curved sections of track is described hereinbelow. It is to be understood that various numbers of blocks 24 and placements of the blocks may be accommodated by modifying the template without deviating from the principles of the present invention. The illustrated template 32 has indexing fixture 34 for maintaining accurate spacing between the blocks 24 already installed onto the rails 22 and the blocks loaded in the template.

The direction in which the representatively illustrated apparatus 10 travels is leftward as illustrated by the arrow 36 in FIG. 1. When the apparatus 10 has traveled sufficiently far that the indexing fixture 34 indicates the proper spacing has been achieved between the previously installed blocks 24 and the blocks loaded in the template 32, the apparatus is stopped. A table winch 38 pulls cable 39 (attached to the table 30) upwardly, thereby raising the table 30 by rotating it about a pivot 40, so that the blocks 24 are properly positioned beneath the rails 22 for fastening thereto. The blocks 24 are then fastened to the rails 22 and the table 30 lowered by the table winch 38.

The apparatus 10 is steered through the subway tunnel 12 by guide arm 42 which acts to maintain a predetermined distance between the apparatus and the cableway wall 18. A roller 44 is positioned to roll atop the cableway wall 18 and thus bias the guide arm 42 laterally when a correction is needed in the travel direction of apparatus 10. Where a structure extending parallel to the roadbed 14, such as the cableway wall 18 is not available, conventional means such as a guide wire system which is typically used for paving machines may be utilized without deviating from the principles of the present invention. On straight alignments, a laser beam guidance system could be utilized as well.

Front portion 46 of the apparatus 10, which is supported on front wheel 48 and intermediate wheels 50, is pivotably mounted to rear portion 52 at pivot 54 so that the apparatus 10 is steerable. Rear portion 52 is supported on two rear wheels 53.

Mounted atop the guide arm 42 are a pair of conventional guide rollers 56 each of which consists of three cylindrical rollers arranged in a "U" shape so that a rail 22 rests on the bottom roller of the "U" and is constrained laterally by the rollers on the sides of the "U". As the apparatus 10 progresses through the subway tunnel 12, the guide rollers 56 lift the rails 22 upwardly off of the roadbed 14.

In a position approximately over the intermediate wheels 50 are a pair of intermediate guide rollers 58, similar to the front pair of guide rollers 56 in that they each consist of three cylindrical rollers configured in a "U" shape. The intermediate guide rollers 58, however, perform an additional function in that they are positioned on the front portion 46 to spread the rails 22 apart to approximately the desired gauge.

A crossmember 60 extends laterally across the front portion 46 rearward from the intermediate guide rollers 58. Mounted to the underside of the crossmember 60 are a pair of rear guide rollers 62 (see FIG. 2) which are similar to the front and intermediate guide rollers 56,58. This pair of guide rollers 62 perform the final gauging of the rails 22 before the blocks 24 are attached and also bias the rails in a downward direction before they enter the rear portion 52 of the apparatus 10.

Various means may be utilized to propel the apparatus 10 through the subway tunnel 12, for example, a conventional bulldozer-type continuous tread drive, gasoline or diesel power, etc., in keeping with the principles of the present invention. The illustrated preferred embodiment apparatus 10 utilizes an electric winch 64 (shown in dashed outline in FIG. 1) mounted to the front portion 46 of the apparatus 10. The winch 64, when activated, pulls on a cable 66 which is secured to the roadbed 14 by a spike 68. Where the cable 66 passes over the guide arm 42 a roller 70 mounted atop the guide arm between guide rollers 56 acts to support the cable.

Referring now primarily to FIG. 2, a cross sectional view of the apparatus 10 in the subway tunnel 12 may be seen, illustrating the manner in which track is laid, only one of the rails 22 being visible in this view. The following description will trace the progress of the single rail 22 shown in FIG. 2 from its entry into the apparatus 10 at the lefthand side to its exit at the righthand side as representatively illustrated in FIG. 2.

The rail 22 is picked up off of the roadbed 14 by guide rollers 56 on the guide arm 42 as the winch 64 pulls on the cable 66 attached to the roadbed 14 with spike 68, thus propelling the apparatus 10 to the left as viewed in FIG. 2. When the rail 22 is initially threaded into the apparatus 10, it must be manually placed onto the guide rollers 56. Guide rollers 56 support and align the rail 22 as it enters the apparatus 10.

The rail 22 next passes through intermediate guide rollers 58. The intermediate guide rollers 58 support and space the rail 22 to approximately the proper gauge distance from the other rail 22 (not shown in FIG. 2).

The rail 22 next passes through rear guide rollers 62 mounted to crossmember 60. The rear guide rollers 62 limit the upward travel of the rail 22 and accurately gauge the rail 22.

The rail 22 next enters the rear portion 52 where the blocks 24 are to be attached. The rail 22 passes between the table 30 and the crane 26. Blocks 24 are loaded onto the table 30 and positioned with the aid of the template 32.

When the indexing fixture 34 indicates that the apparatus 10 has moved forward (in the direction of arrow 36) sufficiently far, the winch 64 is deactivated, and the apparatus stops. The blocks 24 are lifted upwardly to the rail 22 by means of the table winch 38 mounted to the crane 26. The table winch 38 pulls upward on cable 39, thereby raising table 30 (table 30 being rotated about pivot 40). The blocks 24 on the raised table 30 are fastened onto the rail 22 and the table is lowered by table winch 38.

The rail 22 next exits the apparatus 10 when the winch 64 is reactivated to pull the apparatus forward. A spacer 72 is attached to the pair of rails 22 after they exit the apparatus 10 in order to maintain the correct gauge distance between the rails. As more blocks 24 are fastened to the rail 22 and the apparatus 10 moves repeatedly forward, the rail eventually drops far enough downward for the blocks 24 to rest on the roadbed 14. According to conventional practice, the blocks 24 are then prepared for final cementing by, for example, adjusting their positions relative to the roadbed 14, and cement 74 is poured around the blocks.

Figure 3:
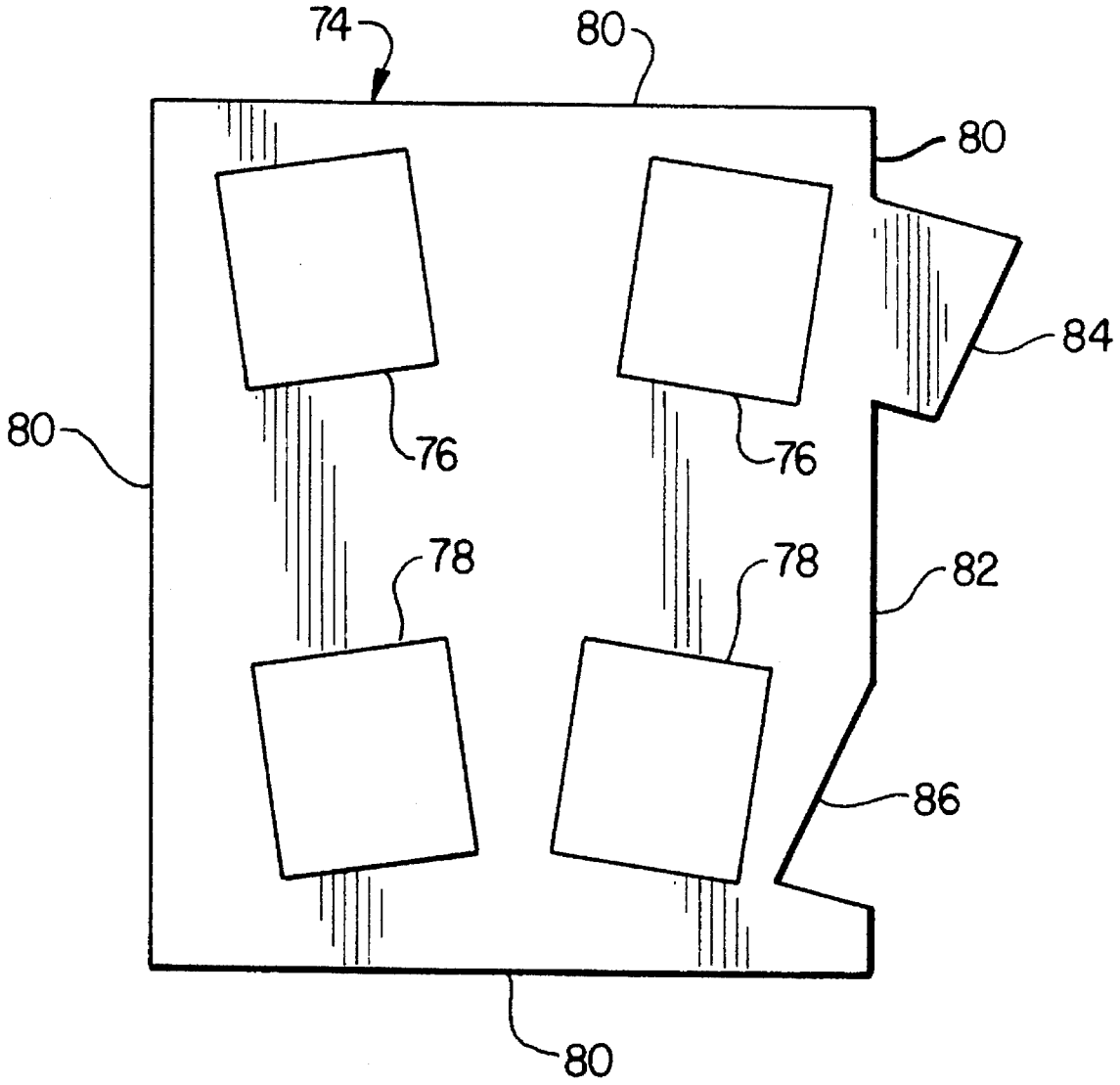
FIG. 3 is a top plan view of a template for use in the apparatus of FIGS. 1 & 2.

Illustrated in FIG. 3 is a specially designed template 74 for use, in place of the previously described "straight" template 32, in laying track on curved sections of roadbed 14. The curvature indicated in FIG. 3 has been exaggerated for illustrative clarity. Template 74 is made of a flat sheet of material such as plywood or steel plate.

In laying track on blocks 24 on curved sections, it is important to maintain the proper longitudinal spacing between the blocks fastened to the outer rail 22 (that is, the rail having the larger radius in the curved section). Consequently, the longitudinal spacing between blocks 24 fastened to the inner rail 22 (the rail having the smaller radius) is reduced as compared to the longitudinal spacing in a straight section of track. The gauge distance between blocks 24 must be maintained in all sections of track.

Outer cutouts 76 in template 74 are for the blocks 24 to be fastened to the outer rail 22. Inner cutouts 78 are for the blocks 24 to be fastened to the inner rail 22. Note that the longitudinal spacing between the outer cutouts 76 is greater than the longitudinal spacing between the inner cutouts 78. Also note that the cutouts 76,78 are not orthogonal to the sides 80 of the template 74; this is because the cutouts are positioned to follow the curvature of the track and the sides of the template are configured to fit the outline of the table 30 in the apparatus 10.

On one side 80 of the template 74, an indexing fixture 82 is positioned so that the proper spacing may be maintained between blocks 24 in the template being fastened to the rails 22 and blocks previously fastened to the rails. For the blocks 24 being fastened to the outer rail, fixture 82 has a protrusion 84. For the blocks 24 being fastened to the inner rail 22, fixture 82 has an indentation 86. The indentation 86 is necessary due to the exaggerated curvature of the illustrated template 74. In actual practice, fixture 82 may have another protrusion in place of the indentation 86.

The template 74 may be used for curvatures in either direction by simply turning the template over on the table 30. When the track again enters a straight section, the straight template 32 may be reinstalled on the table 30.

Thus it can be clearly seen that various templates may be fashioned for different curvatures and block spacings without deviating from the principles of the present invention. Different indexing fixtures may also be utilized. For example, an indexing fixture having an upwardly facing "U" shape may be used to locate two sides of a block 24. As another example, an indexing fixture may be fitted with a limit switch which would stop the winch 64 automatically when the blocks 24 are properly spaced.

The foregoing detailed description is to be clearly understood as being given by way of illustration and example only, the spirit and scope of the present invention being limited solely by the appended claims.

What is claimed is:

1. Apparatus for laying railroad track of the type having two laterally spaced parallel rails supported on a series of longitudinally spaced blocks on a roadbed, the apparatus comprising:

an articulated framework;

a plurality of wheels operatively attached to and supporting said framework;

means mounted to said framework for lifting the rails;

means mounted to said framework for spacing the rails a predetermined lateral distance apart from each other;

means for steering said framework on the roadbed;

means for propelling said framework on the roadbed;

first means mounted to said framework for transporting the blocks from a first location exterior to said framework to a second location on said framework;

means at said second location for spacing the blocks a predetermined transverse and longitudinal distance, relative to the length of the rails, apart from each other; and second means for transporting the blocks from said second location to a third location adjacent the rails.

2. The apparatus according to claim 1, wherein said means for steering comprises:

a guiding structure extending longitudinally along a side of the roadbed and having a top portion;

a roller cooperatively shaped to receive said top portion of said guiding structure and roll longitudinally thereupon; and a guide arm having first and second opposite ends, said first end being secured to said framework and said second end being secured to said roller.

3. The apparatus according to claim 1, wherein said means for propelling comprises:

a spike driven into the roadbed;

a winch attached to said framework; and a cable operatively installed in said winch, said cable being secured at one end to said spike.

4. The apparatus according to claim 1, wherein said first means comprises a crane mounted to said framework and extending laterally therefrom.

5. The apparatus according to claim 1, wherein said spacing means comprises a template.

6. The apparatus according to claim 1, wherein said second transporting means comprises a table pivotably mounted to said framework.

7. A device for installing blocks beneath rails, the device comprising:

an installation portion, said installation portion including:
- a first frame,
- a first plurality of wheels supporting said first frame,
- a crane mounted to said first frame operative to lift the blocks into said installation portion,
- a table pivotably mounted to said first frame,
- a template secured to said table, and
- means for lifting said table; and a positioning portion, said positioning portion including:
- a second frame,
- a second plurality of wheels supporting said second frame,
- means for propelling said second frame,
- a pair of rail lifting members mounted to said second frame,
- a pair of rail spacing members mounted to said second frame, and
- means for articulably attaching said second frame to said first frame.

8. The device according to claim 7, further comprising means mounted to said second frame for steering said first and second frames.

9. The device according to claim 7, wherein said lifting means comprises a winch.

10. The device according to claim 7, wherein said template comprises a planar material having openings therein cooperatively shaped to receive the blocks therein.

11. The device according to claim 10, wherein said template openings are cooperatively spaced to align the blocks to the rails when the rails are curved.

12. The device according to claim 7, further comprising means for indexing said installation portion for successive installations of the blocks to the rails.

13. A method of laying railroad track of the type having two laterally spaced parallel rails supported on a series of longitudinally spaced blocks on a roadbed, the method comprising the steps of:

disposing the rails longitudinally on the roadbed;

lifting the rails upwardly from the roadbed;

spacing the rails apart from each other to a predetermined lateral distance relative to the lengths of the rails;

spacing the blocks apart from each other to said predetermined lateral distance and a predetermined longitudinal distance;

positioning the blocks adjacent the rails;

fastening the blocks to the rails;

providing a spacer for maintaining said predetermined lateral distance between the rails;

installing said spacer on the rails; and laying the rails and blocks onto the roadbed.

14. The method according to claim 13, wherein said disposing step further comprises disposing the rails adjacent each other approximately along the centerline of the roadbed.

15. The method according to claim 13, wherein said lifting step further comprises propelling a first pair of rollers longitudinally along the roadbed, each of said first pair of rollers being disposed intermediate one of the rails and the roadbed.

16. The method according to claim 13, wherein said rail spacing step further comprises propelling a second pair of rollers longitudinally along the roadbed, each of said second pair of rollers being disposed adjacent one of the rails.

17. The method according to claim 13, wherein said block spacing step further comprises:

providing a template, said template having a plurality of openings cooperatively shaped for inserting the blocks thereinto, said openings being spaced apart from each other to said predetermined lateral distance and said predetermined longitudinal distance;

providing means for indexing said template; and inserting the blocks into said template.

18. The method according to claim 13, wherein said step of positioning the blocks adjacent the rails further comprises:

providing a table disposed intermediate the rails and the roadbed;

disposing the blocks on a top surface of said table; and raising said table upwardly until the blocks contact the rails.

19. The method according to claim 13, wherein said laying step further comprising the steps of:

providing a structure extending longitudinally along the roadbed, said structure being parallel to the roadbed;

providing means for laying the rails and blocks parallel to said structure; and laying the rails and blocks onto the roadbed parallel to said structure.

20. The method according to claim 13, wherein the railroad track has a gauge distance between the rails for operative support of a train thereon, and said rail spacing step further comprises spacing the rails apart from each other to said predetermined lateral distance, said predetermined lateral distance being no greater than the gauge distance.

* * * * *